US005483247A

United States Patent [19]

Adrian et al.

[11] Patent Number: 5,483,247

[45] Date of Patent: Jan. 9, 1996

[54] METHOD AND APPARATUS FOR ELIMINATING RESONANCE IN A VEHICLE ANTENNA SYSTEM

[75] Inventors: Andrew Adrian, Ypsilanti; Bruce R. Jones, Romulus; George F. Tannery, IV, Ypsilanti, all of Mich.

[73] Assignee: Ford Motor Company, Dearborn, Mich.

[21] Appl. No.: 359,484

[22] Filed: Dec. 20, 1994

[51] Int. Cl.[6] ..... H01Q 1/32

[52] U.S. Cl. ..... 343/713; 343/704; 343/711

[58] Field of Search ..... 343/713, 704, 343/711, 712; H01Q 1/32, 1/38

[56] References Cited

U.S. PATENT DOCUMENTS

| | | | |
|---|---|---|---|
| 3,961,330 | 6/1976 | Davis | 343/712 |
| 4,764,773 | 8/1988 | Larson et al. | 343/713 |
| 4,827,274 | 5/1989 | Armbruster | 343/712 |
| 4,849,766 | 7/1989 | Inaba et al. | 343/713 |
| 4,920,254 | 4/1990 | DeCamp et al. | 219/547 |
| 5,132,161 | 7/1992 | Shibata et al. | 343/712 |
| 5,181,043 | 1/1993 | Cooper | 343/713 |

*Primary Examiner*—Donald T. Hajec
*Assistant Examiner*—Hoanganh Le
*Attorney, Agent, or Firm*—Lorraine A. Thomas; Roger L. May

[57] ABSTRACT

An automotive antenna system for receiving FM broadcast band radio signals includes a conformal antenna and a glazing panel having an electrically conductive coating. A conductive trace integrated with a front windshield panel, for example, forms an active slot antenna which is connected by a coaxial cable to the automobile's FM radio receiver. A transparent conductive layer is applied over a substantial portion of the rear window opening which is typically dimensioned such that it would otherwise be resonant within the FM broadcast band and parasitically coupled to the active antenna, which would cause the active antenna to have an undesirable directional pattern. The transparent layer has a sufficiently high conductivity and is applied over a sufficiently large portion of the resonant window opening to substantially reduce or eliminate resonances within the FM broadcast band.

5 Claims, 1 Drawing Sheet

METHOD AND APPARATUS FOR ELIMINATING RESONANCE IN A VEHICLE ANTENNA SYSTEM

FIELD OF THE INVENTION

This invention relates to conformal vehicle antenna systems and more particularly to methods and apparatus for eliminating deleterious side effects resulting from the resonance of vehicle window openings at frequencies near those used by motor vehicle radio systems.

BACKGROUND OF THE INVENTION

Conformal automobile FM radio receivers typically are formed in the front or rear window opening of the vehicle. These antennas are designed to provide good reception of signals within the FM broadcast band, 88 to 108 Mhz (3.5 to 2.8 meters wavelength).

Unfortunately, the front and rear window openings which are typically defined by the conductive vehicle body have resonances within the FM broadcast band, and these resonant openings create undesirable distortions from the omnidirectional antenna pattern desired.

It is a principal object of the present invention to reduce the adverse effects which would otherwise result from these undesired electromagnetic resonances.

SUMMARY OF THE INVENTION

In a principal aspect, the present invention takes the form of methods and apparatus for substantially reducing or eliminating undesirable effects on a conformal antenna of a motor vehicle radio system which are caused by the electromagnetic resonance of one or more vehicle window openings within the frequency band used by the radio system. In accordance with the invention, the glazing panel, typically a pane of glass, plastic, or a laminate of such materials, mounted within a potentially offending window opening is coated or otherwise provided with a transparent, electrically conductive layer which extends over a sufficient portion of the panel surface to effectively alter the opening size and reduce or eliminate the undesired resonance.

The principles of the invention may be applied to particular advantage when for a conformal window antenna in either a vehicle windshield or backlite (i.e., rear window) with the conductive coating disclosed here being applied to the other of these glazing panels, to reduce or eliminate the directional pattern distortions that would otherwise result from such other window opening. Vehicle windowshield and backlite dimensions are such that they typically are resonant within the FM broadcast band and, while being spaced from each other, are parasitically coupled to an active antenna in the other.

In accordance with one preferred embodiment, a motor vehicle antenna system has a magnetic current receiving, conformal, substantially rectangular, truncated slot antenna. The slot antenna has a horizontal length L equal to one-half a wavelength in the FM broadcast frequency band. The vertical dimension of the slot antenna, referred to here as its width, is substantially less than dimension L, preferably being only 3% to 20% of dimension L, more preferably 10% to 15% of dimension L. The slot antenna preferably is defined in part by the sheet metal or other conductive periphery of a window opening in the vehicle body. Specifically, the slot antenna is defined in part by a substantially horizontal portion of a conductive periphery of the window opening, typically being formed by the edge of a sheet metal body panel and/or metal frame components for the window opening. The slot antenna is also formed in part by a conductive trace formed integrally with a glazing panel mounted in the window opening. The conductive trace, which may be formed on or imbedded in the glazing panel, extends laterally from a first side point to an opposite side point substantially parallel the aforesaid horizontal portion of the conductive periphery of the window opening. In addition, suitable means are provided for effectively connecting each of the two side points of the conductive trace to the conductive periphery of the window opening. An electrical lead is provided for carrying signals from the slot antenna to a radio receiver. A first conductor of the electrical lead is connected to the conductive periphery of the window opening, and a second conductor of the electrical lead is coupled to the slot antenna either directly (i.e., by an electrical junction) or by a feed network disposed in the slot area.

The conformal antenna may advantageously be a conformal windshield antenna and, hence, be positioned near the radio receiver, with the rear window panel containing a conductive coating to eliminate the resonance defined by the rear window opening within the FM band, thus providing a more omnidirectional reception pattern.

These and other features and advantages of the present invention will be better understood by considering the following detailed description of certain preferred embodiments which are presented with the attached drawing.

DESCRIPTION OF CERTAIN PREFERRED EMBODIMENTS

Figure 1:
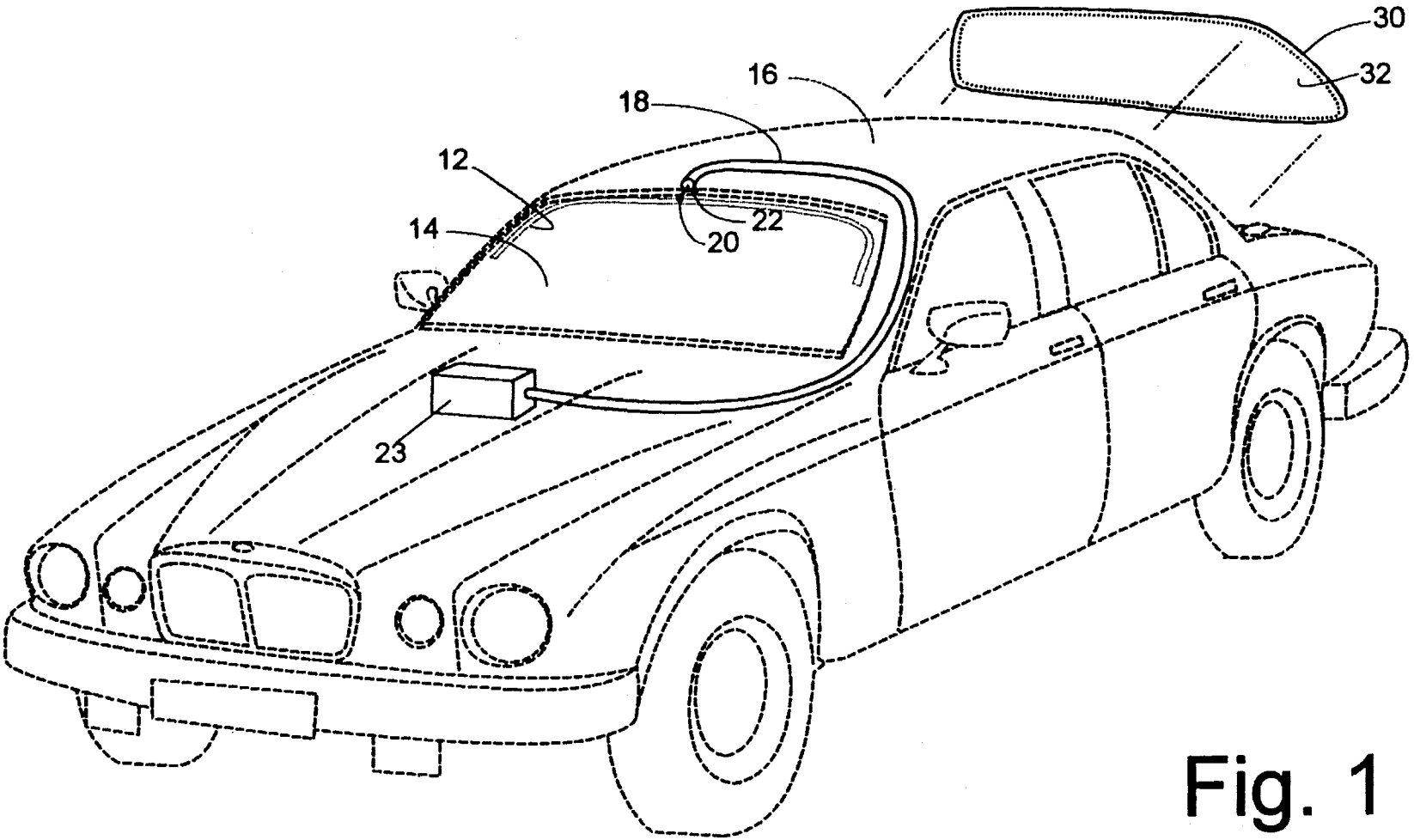
FIG. 1 is a schematic, partially exploded, perspective view of an automobile antenna system which embodies the principles of the invention.

The front and rear window openings of a typical automobile are commonly resonant at frequencies within the FM broadcast band. As described in more detail in commonly assigned and concurrently filed patent application entitled "Motor Vehicle Antenna Systems" (attorney reference 94-263), a vehicle window, typically the front or rear window, may be used to advantage as part of a motor vehicle antenna system as shown generally in FIG. 1. The conformal antenna may advantageously take the form of a horizontal slot antenna formed by a metallized trace 12 applied along a path in the windshield 14 which extends approximately one-half wavelength in the FM broadcast band, parallel to an upper perimeter of the windshield opening 16. Together with ground connections or equivalent vertical extensions at each end of the trace, these elements cooperate to define a slot antenna. The center conductor of a coaxial cable 18 is electrically connected to the trace 12 at junction 20, and the outside sheath conductor is connected to the conductive perimeter surface of the automobile body at 22. The other end of coaxial cable 18 connects to the antenna connector of a conventional FM receiver mounted behind the vehicle dashboard as indicated at 23.

Ideally, an automobile antenna should be essentially omnidirectional. Although some distortions from this desired omnidirectional property are unavoidable, it has been found that the rear and front window openings are often resonant within the FM broadcast band and, when parasitically coupled to the receiving antenna, have a substantial deleterious effect on the directional pattern of reception. The resulting "blind spots" and the like can cause a received station to fade in and out as the orientation of the car changes with respect to the incoming signal direction.

In the preferred embodiments of the invention, this effect is substantially reduced or eliminated by coating the window pane mounted within an offending window opening with an electrically conductive layer which extends over a substantial portion of the pane surface. Preferably, the coating is applied to the entire surface everywhere except at its edges. As shown in FIG. 1, the rear window panel 30 is coated over substantially its entire area with a conductive coating 32, typically before the window pane is installed in the vehicle.

The coating may be any suitable metallized film, of which various commercially available and known types will be apparent to those skilled in the art in view of this disclosure. It should, of course, be sufficiently conductive to alter the electromagnetic characteristics of the window opening to substantially reduce the extent to which it would parasitically alter the effective directional pattern of the antenna. Preferably, it is substantially transparent to visible light. Preferred conductive films are 500 to 10,000 angstroms thick and are formed of silver, zinc oxide, fluorine-doped zinc oxide, cobalt oxide, iron oxide, indium-tin-oxide, chrome oxide, fluorine-doped tin oxide and/or like materials, yielding less than 10 ohms per square resistance, preferably 1–2 ohms per square. Both float deposition processes and finished product deposition processes are suitable, such as sputter coating, chemical vapor deposition, pyrolytic processes and like techniques. Alternative suitable materials and deposition techniques will be apparent, whether presently commercially available or developed hereafter, in view of the disclosure provided here. In accordance with one alternative embodiment, the conductive film comprises an electrically conductive film adapted for electrical resistance heating of a glazing panel, together with an electrically isolated additional film cooperating therewith to provide the desired performance characteristics.

The coating 32 should have sufficient electrical conductivity to effectively alter of the effective electromagnetic dimensions of the window opening and reduce or even eliminate resonance at frequencies within the FM broadcast band. Electrically resistive films of low conductivity of the type typically used to provide electrothermal heating to the windshield to remove fog, frost and ice typically have suitable conductivity to effectively alter the resonant properties of the windshield opening and to satisfactorily meet the objective contemplated by the invention.

It is to be understood that the foregoing description of the preferred embodiment is merely illustrative of one application of the principles of the present invention. The invention may also be used to advantage to improve the omnidirectional reception pattern of other conformal antennas by coating either or both the front or rear window panels. In some vehicles, the side window openings may also exhibit unwanted resonances within the FM broadcast band which can similarly be substantially reduced or eliminated by coating all or a substantial part of the side panel surface(s) with a conductive material. Numerous modifications to the methods and structures described may be made without departing from the true spirit and scope of the invention.

What is claimed is:

1. In combination with a motor vehicle having an electrically conductive body which defines multiple window openings, a communication system for receiving electromagnetically radiated signals within a predetermined frequency band comprising, in combination, a radio receiver adapted to receive and utilize said signals mounted in said vehicle, a conformal antenna element integral with a glazing panel mounted in a first window opening of the motor vehicle, electrically connected to said radio receiver and adapted to be electromagnetically coupled to said signals, a transparent second glazing panel composed of a non-conductive material positioned in a second window opening, said second window opening being dimensioned to be normally resonant at one or more frequencies within said frequency band, and said second glazing panel being spaced from and electromagnetically coupled to said conformal antenna, and a layer of transparent material applied over a substantial portion of the surface of said second glazing panel, said material being sufficiently conductive to alter the electromagnetic characteristics of said second window opening to substantially reduce the extent to which said second window opening parasitically alters the effective directional pattern of said conformal antenna.

2. The communication system as set forth in claim 1 wherein said first and second window openings are the vehicle's rear and front window openings, respectively.

3. The communications system as set forth in claim 1 wherein said transparent conductive layer is adapted for heating said second glazing panel.

4. In a motor vehicle broadcast radio reception system which includes a conformal antenna for receiving radio signals within a predetermined frequency band, said system being mounted in a vehicle having an electrically conductive body which defines window openings which are normally resonant at one or more frequencies within said band, the method of altering the electromagnetic characteristics of said window openings to substantially reduce or eliminate the extent to which said window openings parasitically affect the directional pattern of said conformal antenna, said method comprising the step of applying a layer of transparent and electrically conductive material to glazing panels mounted within said window openings, said layer on each of said glazing panels having sufficient electrical conductivity and extending over a sufficient portion of the glazing panel to render the corresponding window opening substantially non-resonant within said frequency band.

5. The method of claim 4 wherein said conformal antenna is mounted within a first of said window openings and wherein said layer of conductive material is positioned within other window openings spaced from said first window opening.

* * * * *

UNITED STATES PATENT AND TRADEMARK OFFICE

CERTIFICATE OF CORRECTION

PATENT NO. : 5,483,247

DATED : January 9, 1996

INVENTOR(S) : Andrew Adrian, Bruce R. Jones, George E. Tannery IV

It is certified that error appears in the above-indentified patent and that said Letters Patent is hereby corrected as shown below:

Title Page, Item [56], & Col. 2, line 5,

Attorney, Agent, or Firm:

Mark L. Mollon; Roger L. May

Signed and Sealed this

Twenty-first Day of May, 1996

*Attest:*

*Attesting Officer*

BRUCE LEHMAN

*Commissioner of Patents and Trademarks*